US005415152A

United States Patent [19]

Adamson et al.

[11] Patent Number: 5,415,152

[45] Date of Patent: May 16, 1995

[54] METHOD OF LAUNCHING MULTIPLE FIREWORKS PROJECTILES

[76] Inventors: William G. Adamson, 12850 Louvre St., Pacoima, Calif. 91331; Donald Updyke, Jr., 37727 Nantucket Dr., Palmdale, Calif. 93554

[21] Appl. No.: 152,223

[22] Filed: Nov. 12, 1993

Related U.S. Application Data

[62] Division of Ser. No. 897,306, Jun. 11, 1992, Pat. No. 5,282,455.

[51] Int. Cl.[6] ..... F41B 11/00; F41B 11/02; F41B 11/32

[52] U.S. Cl. ..... 124/59; 124/48; 124/77

[58] Field of Search ..... 124/48, 59, 71, 72, 124/73, 77, 82, 56; 89/1.804, 1.812, 1.818

[56] References Cited

U.S. PATENT DOCUMENTS

| | | | |
|---|---|---|---|
| 278,005 | 5/1883 | Fredricks et al. | 124/48 X |
| 399,882 | 3/1889 | Graydon | 124/59 |
| 502,759 | 8/1893 | Rapieff | 124/56 |
| 1,478,597 | 12/1923 | Bebler | 124/59 |
| 3,397,476 | 8/1968 | Weber | 124/72 X |
| 3,827,360 | 8/1974 | Geimer | 124/82 X |
| 4,040,334 | 8/1977 | Smethers | 89/1.804 |
| 5,339,741 | 8/1994 | Craven et al. | 102/361 |

*Primary Examiner*—Randolph A. Reese

*Assistant Examiner*—John A. Ricci

*Attorney, Agent, or Firm*—Pretty, Schroeder, Brueggemann & Clark

[57] ABSTRACT

A method of successively launching a plurality of projectiles, such as fireworks projectiles, which explode into an aerial pyrotechnic display. The projectiles are launched from a launcher having a pressure tank containing a compressed gas and a plurality of launching tubes for holding the projectiles. The launching tubes are constructed to form a magazine to enable successive launching of fireworks projectiles by appropriate indexing of the magazine which brings the launching tubes into registration with the output port of a valve. The valve introduces compressed gas into one of the launching tubes to launch a projectile into the air. Indexing of the launching tubes when the pressure tank is pressurized prior to launch is prevented by a stop mechanism. The stop mechanism also prevents inadvertent or accidental detonation of the projectile in the launching tube. The method further includes the step of aiming the projectiles, preferably with an aiming apparatus comprising actuators that support the launcher and which are adjustable to change the launching angle of the launcher with respect to the ground each time a new launching tube is indexed to a launching position. The adjustment of these actuators is controlled by pneumatic switches that are operated during indexing of the launching tubes.

18 Claims, 7 Drawing Sheets

48
92
84
78
60
80
82
90
84
76
88
14
34
74
86
48
46
16
82
92
88
84
60
80
90
84
76
88
78
47
46
46
14
74

Fig.9A
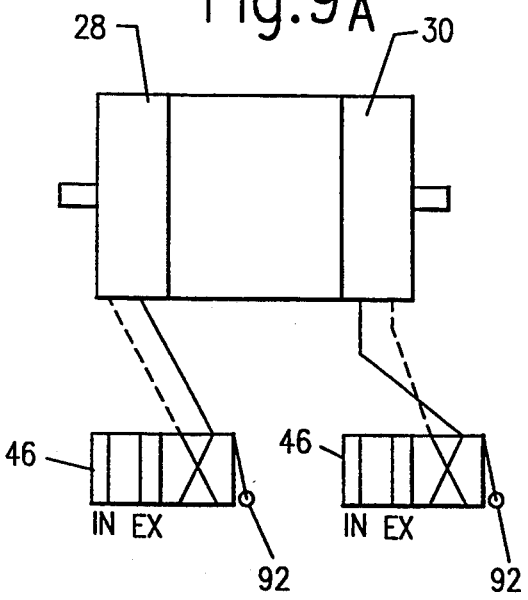
Fig.9B
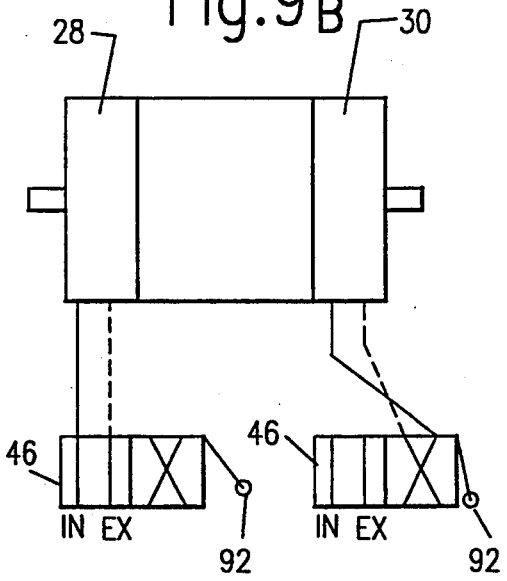
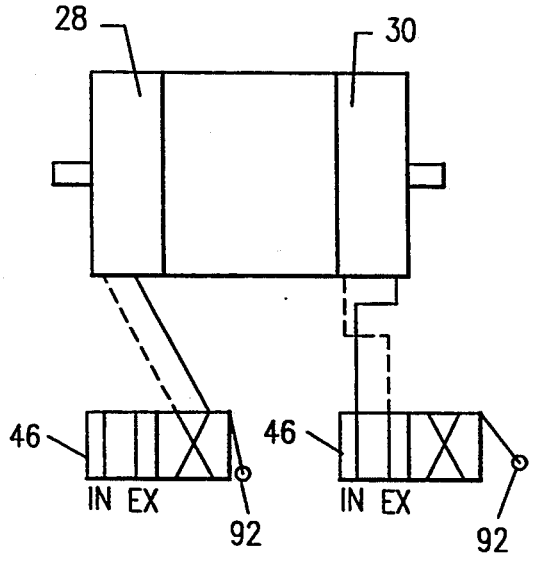
Fig.9c
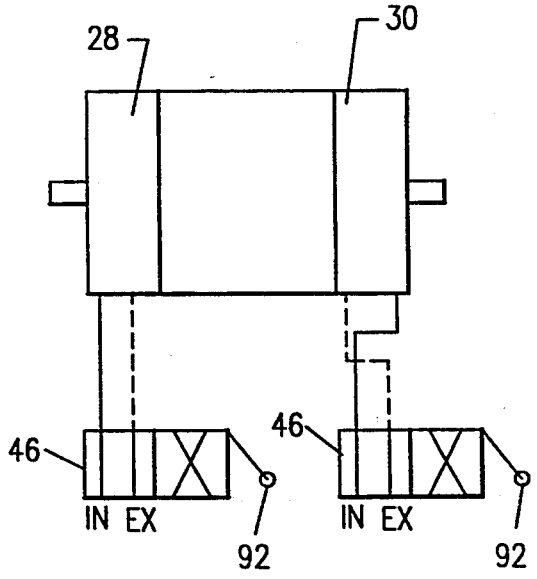
Fig.9D

METHOD OF LAUNCHING MULTIPLE FIREWORKS PROJECTILES

This application is a division of application Ser. No. 07/897,306, filed Jun. 11, 1992, now U.S. Pat. No. 5,282,455.

BACKGROUND OF THE INVENTION

The present invention relates to launching devices for fireworks projectiles and, more particularly, to a launcher for holding and successively launching a plurality of such projectiles.

Pyrotechnic displays, commonly referred to as fireworks or fireworks displays, have been created and enjoyed for centuries by millions of people. Typical systems of the prior art for creating fireworks displays include a pyrotechnic projectile and a mortar for launching the pyrotechnic projectile into the air. Typical pyrotechnic projectiles comprise an inner shell with a main burst that detonates in the air and an initial burst enclosed within an outer shell. By manually igniting an initial fuse, the initial burst is exploded and expels the pyrotechnic projectile from the mortar into the air. This explosion, in turn, lights a main fuse which takes a specific time to burn into and ignite the main burst into an aerial pyrotechnic display.

Typical prior art mortars are cylindrical in shape and are constructed of rigid materials, such as cardboard, metal or plastic. This relatively simple mortar construction requires that the pyrotechnic projectile have a specific orientation within the mortar. The orientation provides for the outer shell having the initial burst to be arranged so that it is below the main burst. When the initial burst is ignited, it explodes and expels the pyrotechnic projectile from the mortar. This explosion produces a loud noise, objectionable quantities of smoke and extremely corrosive agents at the launch site resulting from combustion of the initial burst. Moreover, existing mortar construction generally is not conducive to adjustment after installation at the launch site. As a result, it is difficult and sometimes impossible to change the orientation of the mortar so as to aim the pyrotechnic projectile to different locations in the sky.

Special problems also are encountered when attempting to successively launch pyrotechnic projectiles from the same mortar. This involves loading a first pyrotechnic projectile into the mortar and then lighting the initial fuse at the appropriate time. After this, for safety reasons the mortar site must be cleared before the initial burst explodes. To launch the next pyrotechnic projectile, the operator must return to the mortar and repeat the same process with another pyrotechnic projectile. Hence, constant operator intervention is required and it is not possible to conveniently and quickly launch successive pyrotechnic projectiles from the same mortar. As noted above, problems also exist when it is desired to change the orientation of the mortar from one projectile to the next.

The foregoing problems with prior art mortars were recognized and solved by the inventions disclosed and claimed in U.S. Pat. No. 5,339,741. One of these inventions provides a launching device which uses a remote, non-explosive launching medium to rapidly expel a new type of fireworks projectile into the air. The launcher comprises a pressure tank containing compressed gas and a launching tube having a lower end connected to the pressure tank and an open end for expelling the projectile into the air. A valve connected between the pressure tank and the launching tube is opened and closed to accurately introduce a predetermined amount of compressed gas, at a controlled pressure, from the pressure tank to the launching tube. Upon release, the pressure of the gas rapidly expels the projectile from the open end of the tube. An electronic fuse on the projectile is programmed to detonate the main burst of the projectile at a predetermined time after launch. No initial burst is needed.

In one of the disclosed embodiments of U.S. Pat. No. 5,339,741, the launcher includes a multiple breech comprising a row of cylindrical tubes containing the projectiles to be launched. Each of the tubes is moved successively into registration with the main launching tube into which the compressed gas is released for launching the projectile. The row of cylindrical tubes can be arranged in a straight row or in a circular or cylindrical manner. An appropriate means may be provided for indexing the tubes such that the projectiles can be launched in succession at a predetermined time or rate.

Notwithstanding the improvements in launching devices provided by the compressed gas launcher described above, further versatility still is desired. For example, it is desirable to ensure that the launching barrels containing the projectiles will not inadvertently advance while the pressure tank is pressurized. It also is desirable for safety reasons to ensure that the main burst of the projectile will not accidentally or inadvertently detonate before the valve opens for launching. In addition, it would be desirable to have the ability to change the launching angle of the various launching tubes once they have registered for firing.

Accordingly, there has existed a need for a device for successively launching and detonating fireworks projectiles, in which the launching angle can be controlled and varied for each launching tube, and which prevents accidental or inadvertent firing of a projectile from the wrong launching tube. The present invention satisfies these and other needs, and provides further related advantages.

SUMMARY OF THE INVENTION

The present invention provides a launcher for holding and successively launching a plurality of fireworks projectiles with increased safety and efficiency. The launcher has a positive stop mechanism that prevents the launcher's launching tubes from indexing until the previous projectile has been launched and also prevents accidental or inadvertent detonation of the projectiles while they are still in their respective launching tubes. An aiming apparatus also provides convenient and accurate adjustment of the launching angle of the launcher for each of the projectiles that are indexed into a launching position. The launcher of the present invention furthermore is intended to be relatively simple in construction, reliable in operation and low in maintenance.

The launcher comprises a pressure tank containing a compressed gas and a plurality of launching tubes for holding the projectiles. A valve connected between the pressure tank and the launching tubes is opened and closed in a precise and controlled manner to accurately introduce an exact, predetermined amount of compressed gas from the pressure tank into an output port on the valve. Each of the launching tubes has an open lower end that is adapted to move into registration with the output port of the valve. Thus, when the valve is opened, the force of the compressed gas expels the projectile from an open upper end of the launching tube.

When a selected launching tube has been registered with the valve's output port and the pressure tank is pressurized for launching, the stop mechanism advantageously prevents indexing of the other launching tubes. The stop mechanism comprises an actuator having a plunger that is movable between an engagement position and a disengagement position. In the engagement position, the plunger is moved into engagement with a notch on a frame that holds the launching tubes to prevent indexing of the tubes when the pressure tank is pressurized. In the disengagement position, the plunger is retracted away from the frame and out of the notch to allow indexing of the launching tubes.

Indexing of the launching tubes is enabled by an indexing mechanism that is operated after one of the projectiles has been launched. The indexing mechanism rotates the frame holding the launching tubes so that each of the launching tubes can be brought into registration with the output port of the valve at the appropriate time. For safety reasons, the indexing mechanism cannot carry out an indexing cycle until the plunger is in the disengagement position and the pressure tank is substantially depressurized. When these two conditions are met, the launching tubes can be indexed until the next adjacent launching tube is properly registered with the valve's output port. After this, the plunger of the stop mechanism is moved back to the engagement position to prevent unwanted indexing of the launching tubes.

Each of the projectiles contains a fuse adapted to detonate a main burst inside the projectile's shell at a predetermined time after the projectile is launched. Each fuse also has two leads which are connected to two matching terminals located just outside each launching tube on a plurality of mounting plates on the frame. To prevent inadvertent or accidental operation of the fuses that might detonate the projectiles while they are still in their respective launching tubes, each of the pair of terminals is shunted. Thus, programming of the fuse, which is essentially dead, and detonation of the projectile is prevented. However, when a selected one of the launching tubes is registered with the valve's output port, a pair of contacts on the plunger are adapted to engage the terminals when the plunger is in the engagement position. These contacts transfer information from a local control unit at the launcher to the fuse. This information includes programming the fuse to detonate the projectile at a predetermined time after it has been launched and its leads have been separated from the terminals. Alternatively, the contacts may be replaced by plugs on the plunger which engage sockets on the frame that are connected to the terminals to carry out the fuse programming functions. One of these plugs and sockets also can be used to ground the launching tube to prevent static charges from building up in the tube that might accidentally cause the projectile to detonate in the tube.

In another aspect of the invention, the launcher is provided with an aiming apparatus for adjusting the launching angle of the launcher and aiming of the projectile to a particular location in the sky. The aiming apparatus comprises a first actuator and a second actuator which support the launcher and which are adjustable to change the launcher's launching angle. These actuators are movable independent of each other and are controlled by switches that, in turn, are operated by movement of the frame during indexing of the launching tubes. Thus, during each indexing cycle of the frame, the actuators can be adjusted to change the launching angle for each of the launching tubes.

In the preferred embodiment, the switches are pneumatic switches operated by lobes or cams on the mounting plates associated with each launching tube. These switches control the flow of pressurized air to the first and second actuators that control the launching angle. By properly positioning the cams on the mounting plates, the switches can be selectively operated or not operated in a number of combinations that give a variety of launching angles. The invention further provides for additional switches that control operation of the stop mechanism and the indexing mechanism.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is an elevational view, partly in cross-section, of a launcher embodying the novel features of the present invention;

FIGS. 9A–9D are block diagrams showing a pneumatic circuit for controlling operation of an aiming apparatus of the launcher;

DETAILED DESCRIPTION OF THE PREFERRED EMBODIMENT

Figures 7, 8:
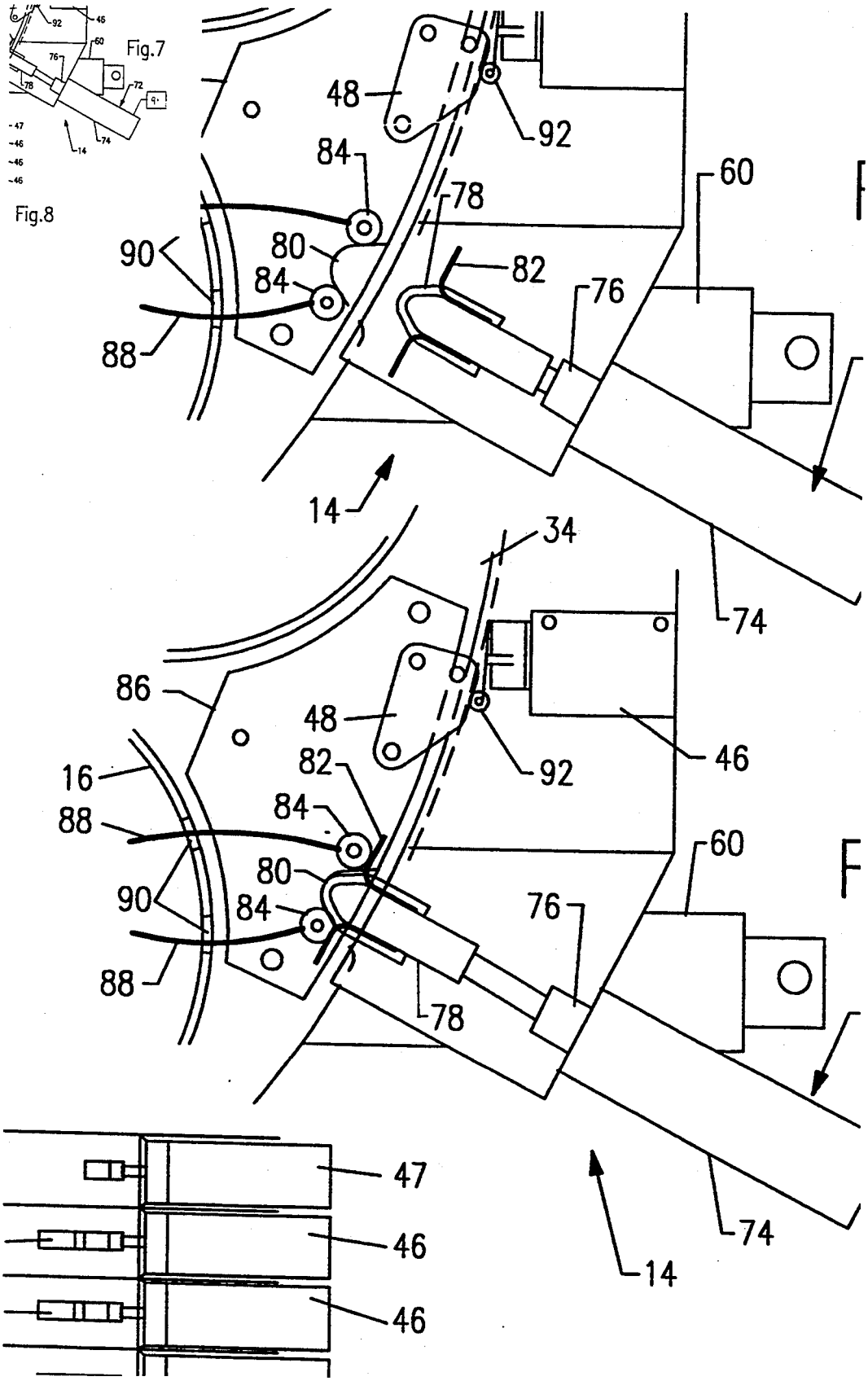
FIG. 7 is an enlarged plan view, similar to FIG. 6, showing the stop mechanism in an engaged position.
FIG. 8 is an elevational diagrammatic view showing the switches of FIGS. 6–7.

As shown in the accompanying drawings, the present invention is embodied in a launcher, generally referred to by the reference numeral 10, for holding and successively launching a plurality of projectiles 12, such as fireworks projectiles, for exploding into an aerial pyrotechnic display. The launcher 10 advantageously uses a nonexplosive launching medium to rapidly expel the projectile from the launcher where it is detonated in the sky at a predetermined time after launch. A unique stop mechanism 14 prevents indexing of the launcher's launching tubes 16 until after the projectile 12 is launched and also prevents accidental or inadvertent detonation of the other projectiles until they are ready to be launched. An aiming apparatus 18 also is provided to adjust the launching angle of the launcher 10 for each of the projectiles 12 to be successively launched from the launcher. Further features and advantages of the present invention are described below.

FIG. 1 is an elevational view showing the overall structure of the launcher 10. The launcher 10 comprises a pressure tank 20 and a plurality of the launching tubes 16 containing the projectiles 12 to be launched. The pressure tank 20 contains a compressed gas, such as air, supplied to the tank from a compressed gas source (not shown) by a suitable hose 22. The lower end of the pressure tank 20 is connected by a universal joint 24 to a rigid, preferably horizontal structure, which may be the ground 26 or any appropriate supporting platform or the like. The universal joint 24 permits relatively unrestricted pivoting motion of the launcher 10 with respect to the ground 26.

The pressure tank 20 also is supported by a plurality of actuators 28 and 30, each having one end pivotally connected to a side of the pressure tank 20 and an opposite end pivotally connected to the ground 26 by suitable connecting brackets 32. These actuators 28 and 30 are designed to both support and adjust the angle of the launcher 10 with respect to the ground 26. This allows the projectiles 12 to be aimed to different locations in the sky, as desired. The function and operation of the these actuators 28 and 30 is described in more detail below.

Figure 2:
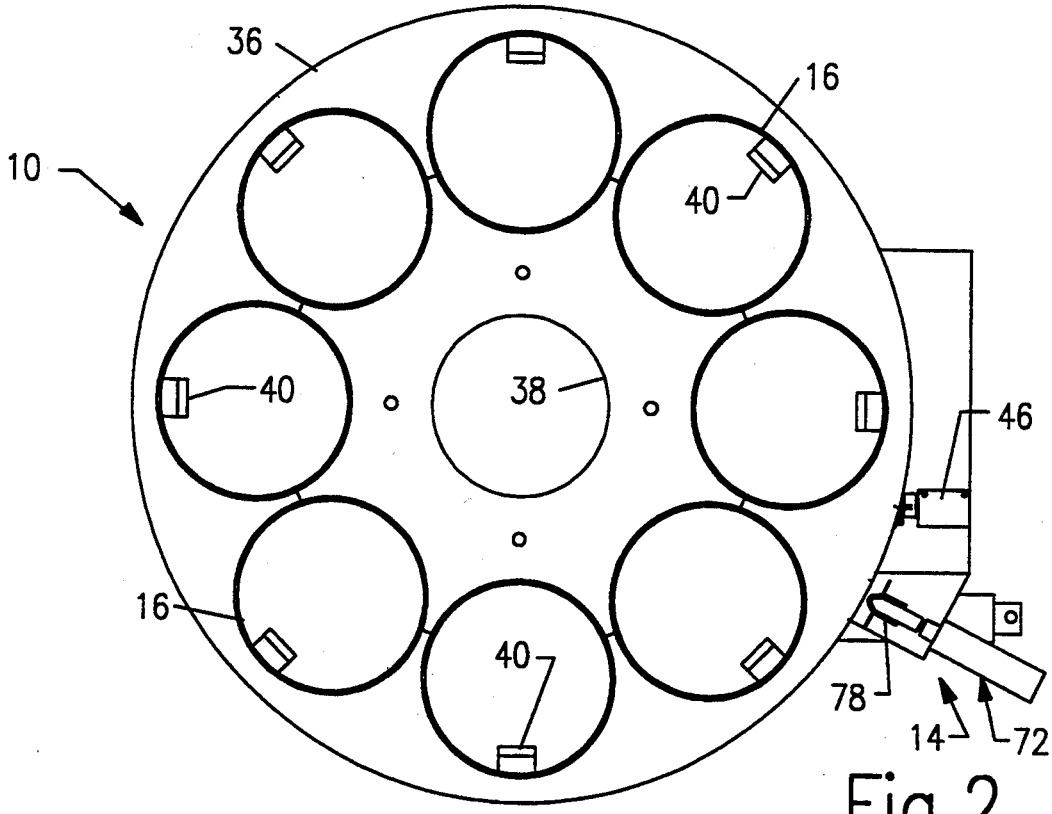
FIG. 2 is a cross-sectional plan view of the launcher, taken substantially along line 2—2 of FIG. 1.

FIG. 2 is a plan view of the launcher 10 showing the arrangement of the launching tubes 16. These launching tubes 16 are about four feet in length and have a diameter that corresponds to the size of the projectile 12. In the preferred embodiment, the launching tubes 16 are arranged in a cylindrical manner and are supported by a frame 34 at their lower ends. An internal positioning bracket 38, shown best in FIG. 2, also provides appropriate spacing and stabilization of the launching tubes 16. Two of these brackets 38 are provided, one being about one foot above the frame 34 and the other being about three feet above the frame. A pair of metal bands 36 or the like surround the tubes 16 to hold them tightly together in cooperation with the brackets 38.

The foregoing construction provides a magazine of launching tubes 16 that each holds a fireworks projectile 12. These projectiles 12 may be held in position in the launching tube 16 by appropriate means, such as a piece of spring steel 40 or the like connected to the inside surface of the launching tube adjacent to its lower end. To load the projectiles 12 into the launching tubes 16, the projectiles are inserted upwardly through the open lower end of the launching tubes past the spring steel 40 where they are conveniently held in position until launch.

The introduction of pressure from the pressure tank 20 to the launching tubes 16 is controlled by a valve 42 connected between the pressure tank and the launching tubes. When it is desired to launch a projectile 12 from one of the launching tubes 16, and the pressure tank 20 is at the appropriate pressure level, the valve 42 is opened for a predetermined period of time to release an exact volume of compressed gas through an output port 44 above the valve 42 and into the launching tube 16 that is registered at that time with the output port 44. The force of the compressed gas rapidly accelerates and expels the projectile 12 from the open upper end of the launching tube 16. By accurately controlling the pressure in the tank 20 and the amount of pressure released into the launching tube 16 by the valve 42, the projectile 12 can be launched into the air to a relatively precise altitude and at a relatively precise velocity. In one embodiment of the invention, the pressure tank 20 is pressurized to levels from 20 psi to 150 psi to enable launching of the projectile 12 to altitudes ranging from 50 feet to 2,000 feet or higher, with tube exit velocities as high as 500 ft/sec.

The valve 42 which opens and closes to release pressure from the pressure tank 20 into the launching tube 16 can be of any suitable construction, so long as it is fast acting, with a minimum opening time on the order of 12 milliseconds. It also must be capable of withstanding the pressures involved. In one embodiment of the invention, a butterfly valve has been used. Suitable butterfly valves are available from Fisher Controls, such as an 8 inch valve identified as Type 1066, Body 8522. The pressure tank 20 preferably is constructed from metal, and the launching tube 16 may be constructed from suitable rigid materials, such as metal, plastic or fiberglass. When fiberglass materials and the like are used, it may be desirable to add an internal coating designed to reduce the charge created in the launching tube 16 during launching of the projectile 12.

Figure 3:
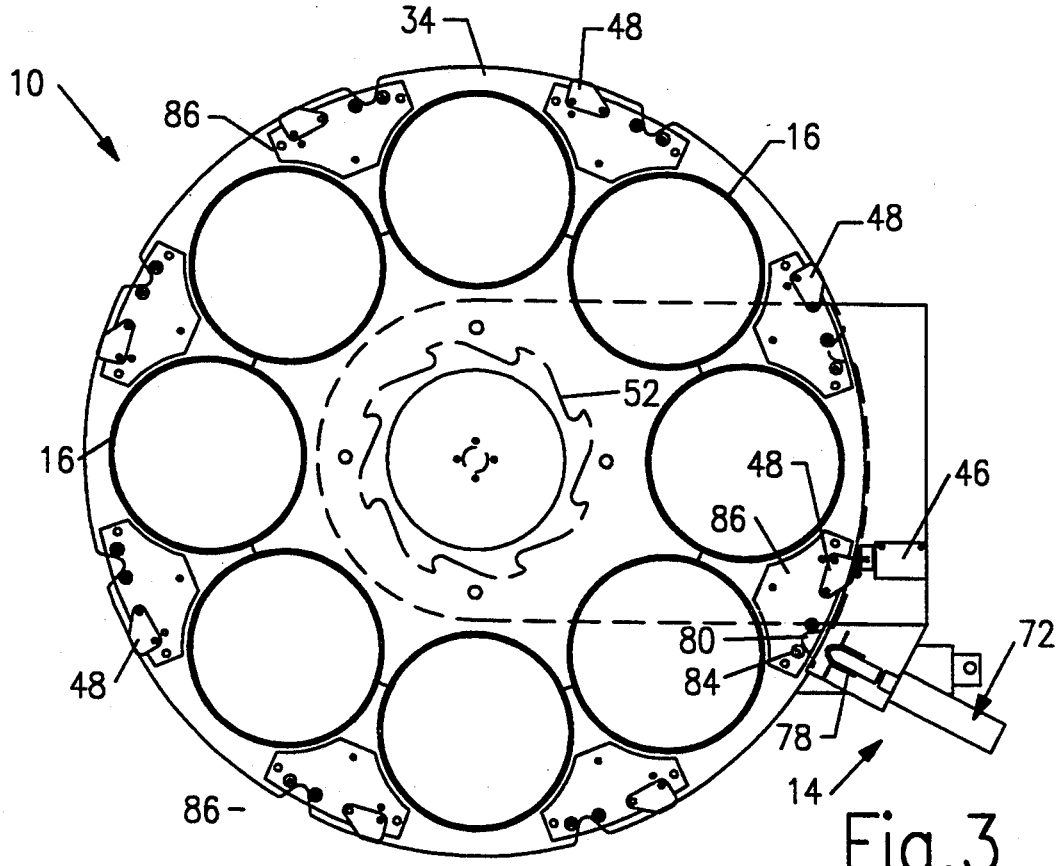
FIG. 3 is a cross-sectional plan view of the launcher, taken substantially along line 3—3 of FIG. 1.

FIG. 3 is a cross-sectional plan view of the launcher 10 showing the stop mechanism 14 that prevents indexing of the launching tubes 16 when the pressure tank 20 is pressurized. This stop mechanism 14 also prevents accidental or inadvertent detonation of the projectiles 12 until it is time for them to be launched. FIG. 3 also shows one of a plurality of switches 46 and cams 48 that operate together to control several features of the launcher 10, such as the actuators 28 and 30 that aim the launcher. These features are shown in more detail and described later in conjunction with FIGS. 6–10.

Figure 4:
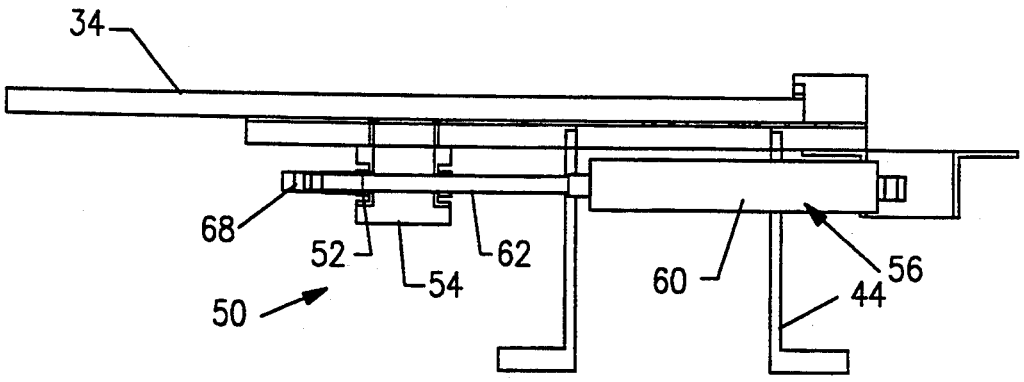
FIG. 4 is an elevational view of an indexing mechanism of the launcher.
Figure 5:
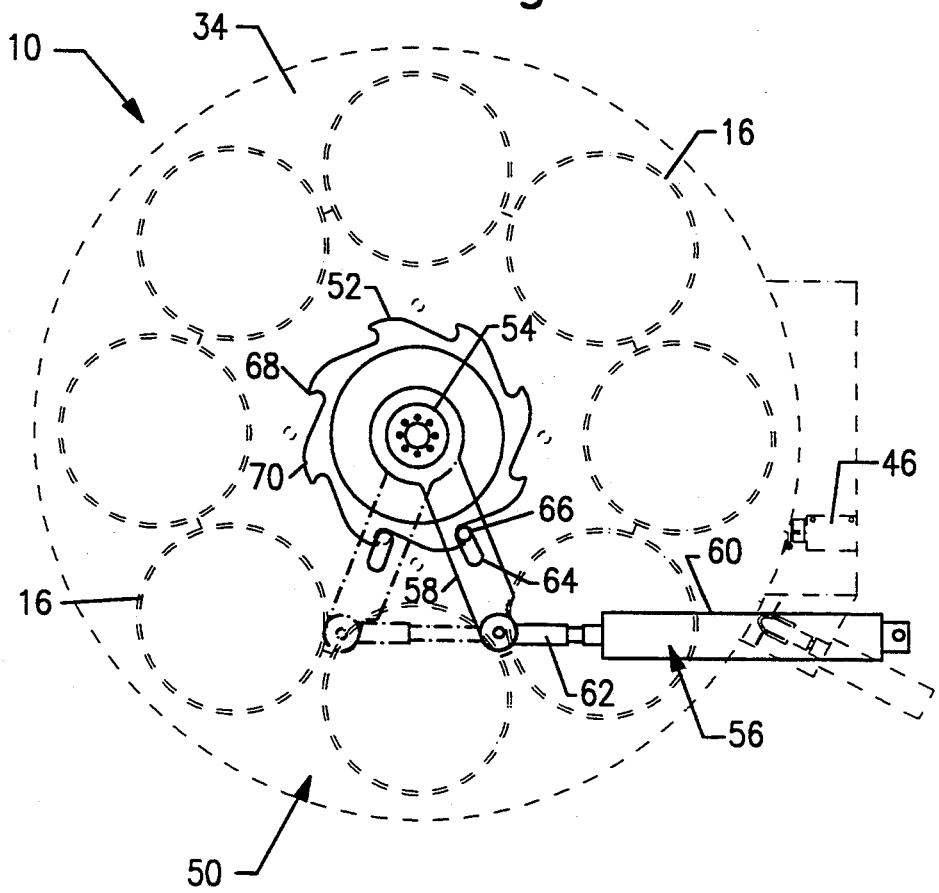
FIG. 5 is a cross-sectional plan view of the launcher, taken substantially along line 5—5 of FIG. 1, showing the indexing mechanism, with portions of the launcher also shown in phantom for reference.

FIGS. 4–5 show an indexing mechanism 50 that controls indexing of the launching tubes 16 so that, after a projectile 12 has been launched from one of the launching tubes, the next launching tube 16 can be brought into registration with the output port 44 of the valve 42 for launching of the next projectile 12. The indexing mechanism 50 comprises a sprocket wheel 52 rigidly connected to a shaft 54 extending from the frame 34 holding the launching tubes 16. Thus, rotation of the sprocket wheel 52 causes rotation (i.e., indexing) of the launching tubes 16. Rotation of the sprocket wheel 52 is caused by a ratchet assembly comprising an actuator 56 and an arm 58. The actuator 56 has a cylinder 60 and rod 62 that extends out of the cylinder 60. The end of the rod 62 outside the cylinder 60 is pivotally connected to one end of the arm 58. The other end of the arm 58 is pivotally connected to the shaft 54 on the launching tube frame 34. The midpoint of the arm 58 has an elongated slot 64 that slidably retains a pin 66. This pin 66 is adapted to engage one of the teeth 68 of the sprocket wheel 52 to cause rotation of the frame 34 during the indexing cycle of the launcher 10.

The rod 62 of the actuator 56 is designed to normally be in a retracted state. In this state, shown by the solid lines in FIG. 5, the pin 66 is normally engaged with one of the teeth 68 of the sprocket wheel 52. During an indexing cycle, the rod 62 is moved to an extended position, shown by the phantom lines in FIG. 5, thus pivoting the arm 58 about the shaft 54 and causing the pin 66 to rotate the sprocket wheel 52. The stroke of the rod 62 is sufficient to rotate the sprocket wheel 52 such that the next launching tube 16 is precisely registered with the output port 44 of the valve 42. In one form of the invention, an actuator 56 having a diameter of about 1 ½ inches and a stroke of about six inches has been suitable. At the end of the stroke, the rod 62 returns to its normally retracted state within the cylinder 60. As the rod 62 retracts, the pin 66 slides over the curved outer surface 70 of the next tooth 68 of the sprocket wheel 52 that the pin 66 will engage. During this retract cycle, the pin 66 also slides within the elongated slot 64 of the arm 58 until it clears the tip of the tooth 68 and is moved back into engagement with the next tooth by appropriate biasing means. At this point, the indexing mechanism 50 is ready for the next indexing cycle and the process is repeated when the next projectile 12 is launched.

In the preferred embodiment, the actuator 56 of the indexing mechanism 50 is pneumatically operated. Thus, the actuator's cylinder 60 will have two ports into which compressed air is received, with a piston (not shown) positioned between the two ports and connected to the rod 62. In the normally retracted state, the compressed air will be fed to the port on the front side of the piston (i.e., on the side of the piston connected to the rod 62), while the other port on the back side of the piston is vented. During the indexing cycle, however, the port on the front side of the piston will be vented and compressed air will be fed to the port on the back side of the piston to extend the rod 62 and carry out the indexing cycle.

Figure 6:
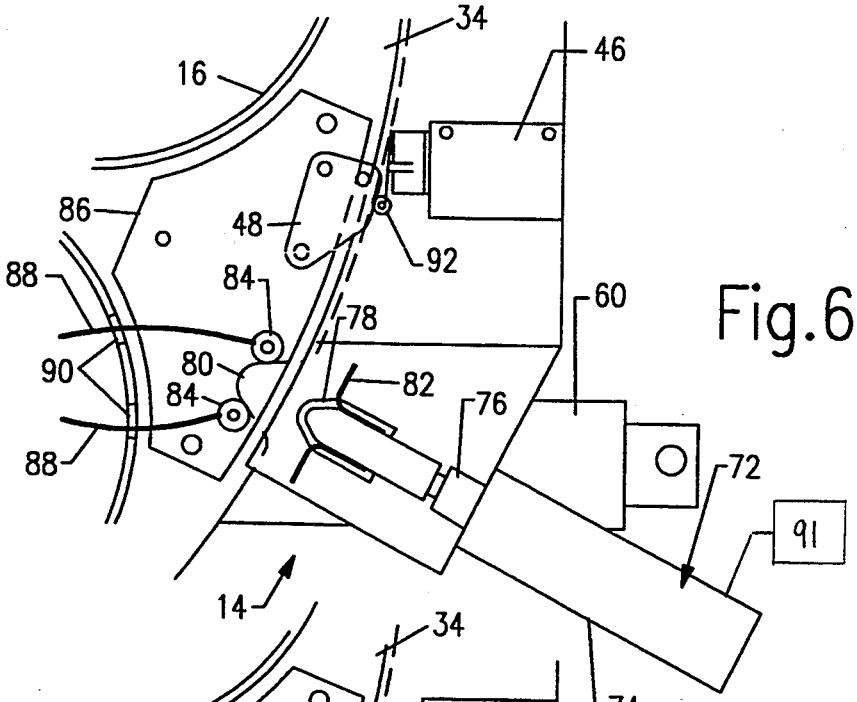
FIG. 6 is an enlarged plan view of a portion of the launcher showing switches and a stop mechanism in a disengaged position.
Figure 7:
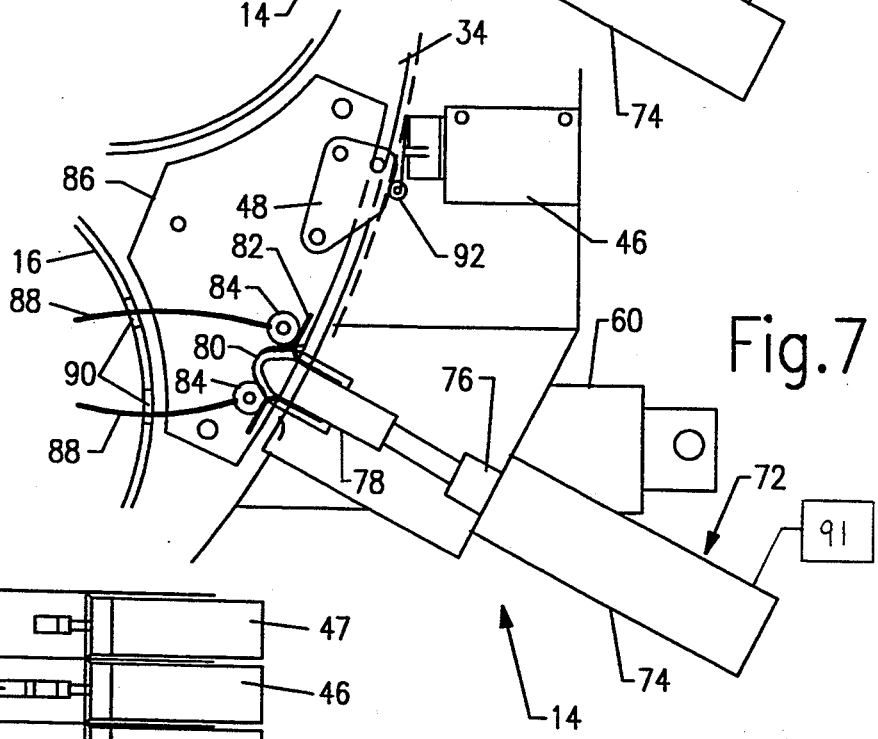
Figure 8:
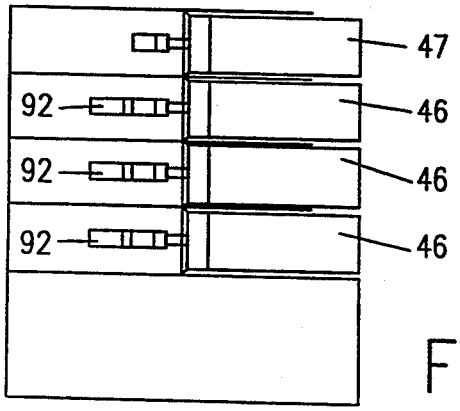

FIGS. 6–8 show the stop mechanism 14 and the switches 46 mentioned above in greater detail. The stop mechanism 14 performs two specific functions. One function is to prevent indexing of the launching tubes 16 when the pressure tank 20 is pressurized. Another function is to enable programming of a fuse 114 on the projectile 12 to be launched and to prevent inadvertent or accidental detonation of the projectile until the fuse is programmed and ready to be launched. The switches 46 also have multiple functions. One function is to control operation of the stop mechanism 14 and the indexing mechanism 50. Another function is to adjust the actuators 28 and 30 that control the aiming of the launcher 10. These and other functions will now be described in conjunction with the structure illustrated in FIGS. 6–8.

The stop mechanism 14 is illustrated best in FIGS. 6–7. It comprises an actuator 72 having a cylinder 74 and a rod 76 with a plunger 78 connected to the outer end of the rod. The plunger 78 is adapted to move between two positions, namely a disengagement position and an engagement position. In the disengagement position, shown in FIG. 6, the plunger 78 is retracted away from the frame 34 holding the launching tubes 16. While in the disengagement position, the indexing mechanism 50 is free to rotate the frame 34 and cause appropriate indexing of the next launching tube 16 into registration with the output port 44 of the valve 42. In the engagement position, shown in FIG. 7, the plunger 78 is extended toward the frame 34 and into engagement with a notch 80 in the frame. While in the engagement position, the frame 34 is prevented from rotating and, thus, there can be no accidental or inadvertent indexing of the launching tubes 16.

Like the actuator 56 of the indexing mechanism 50, the actuator 72 of the stop mechanism 14 is preferably pneumatically operated. Thus, the cylinder 74 has two ports into which compressed air is received, with a piston (not shown) positioned between the two ports and connected to the rod 76. In the preferred embodiment, the plunger 78 normally is in the engagement position while the actuator 56 of the indexing mechanism 50 is in the normally retracted state. In this normal engagement position of the plunger 78, compressed air is fed to the port on the back side of the piston while the port on the front side of the piston (i.e., the side of the piston connected to the rod 76) is vented. This advances the plunger 78 into engagement with the notch 80 on the frame 34, as shown in FIG. 7. During indexing of the launching tubes 16, however, the plunger 78 is retracted out of the notch 80. This is enabled by venting the port on the back side of the piston and feeding compressed air to the port on the front side of the piston to retract the rod 76 and disengage the plunger 78 from the notch 80, as shown in FIG. 6. With the plunger 78 disengaged from the notch 80, the frame 34 is free to rotate during indexing of the launching tubes 16. In one form of the invention, the actuator 72 of the stop mechanism 14 has a diameter of about 1-1/16 inches and a stroke of about one inch.

To carry out the function of programming the fuse 114 on the projectile 12 and preventing inadvertent or accidental detonation of the projectile, the plunger 78 is provided, in one embodiment of the invention, with a contact 82 adjacent its outer end. When the plunger 78 is in the engagement position, shown in FIG. 7, the contact 82 is adapted to engage two terminals 84 connected to a mounting plate 86 on the frame 34. As shown in FIG. 3, there is one mounting plate 86 and a pair of terminals 84 for each launching tube 16. The terminals 84 are designed to receive the leads 88 associated with each projectile 12. To connect the projectile leads 88 to the terminals 84, the leads are passed through holes 90 in the launching tube 16 and the ends of the leads 88 are suitably connected to the terminals 84. Before the contact 82 engages the terminals 84, the leads 88 are shunted to prevent accidental or inadvertent detonation of the projectile 12. In this shunted condition, the fuse 114 is dead and cannot be programmed to detonate the projectile 12. However, when the contact 82 on the plunger 78 engages the terminals 84, the leads 88 are no longer shunted. In this unshunted condition, the fuse 114 is live and can be programmed by a local control unit 91 to detonate the projectile 12 at a predetermined time after launch. This predetermined time starts to run when the projectile 12 is launched and the leads 88 are separated from their terminals 84. However, since the contact 82 will not engage the leads 88 until relatively shortly before the projectile 12 is to be launched, the leads remain in a shunted condition to thereby prevent inadvertent or accidental detonation of the projectile in the launching tube 16.

FIGS. 6–8 also show the switches 46. The switches 46 in the preferred embodiment are air switches that control the flow of compressed air to the actuators 56 and 72 of the indexing mechanism 50 and the stop mechanism 14, as well as the actuators 28 and 30 that control aiming of the launcher 10. Each of the switches 46 has a cam roller 92 that is positioned adjacent the frame 34 holding the launching tubes 16. Operation of these switches 46 is controlled by a plurality of the cams 48 connected to the mounting plate 86 on the frame 34. As shown in FIG. 3, there are a plurality of such cams 48 on the mounting plate 86 associated with each launching tube 16. When the cam roller 92 on the switch 46 engages the cam 92, then the switch 46 is operated.

FIGS. 9A–9D are block diagrams showing one embodiment of a pneumatic circuit for controlling operation of the actuators 28 and 29 of the launcher's aiming apparatus 18. In FIGS. 9A–9D, the solid lines between the switches 46 and actuators 28 and 30 represent pressurized lines and the dashed lines represent exhaust or vented lines. In the case of the actuators 28 and 30 for aiming of the launcher 10, two switches 46 are provided. Each of these switches 46 are operated by the cams 48 and controls the adjustment of one of the actuators 28 or 30 by controlling the flow of compressed air to these actuators. In one embodiment of the invention, the switches 46 can be operated to provide four different launching angles of 0, 5, 8 and 11 degrees, with zero degrees being a completely vertical launch.

To obtain a zero degree launching angle, both of the switches 46 are operated by their respective cams 48 and air pressure is fed to both actuators 28 and 30 to fully extend them, as shown in FIG. 9A. To obtain a 5 degree launching angle, one switch 46 is operated and the other is left unoperated, as shown in FIG. 9B. This feeds pressure to one of the actuators 28 to extend it and feeds pressure to the other actuator 30 to retract it. To obtain an 8 degree launching angle, the other switch 46 is operated and the one switch is left unoperated, as shown in FIG. 9C. This extends the other actuator 30 and retracts the one actuator 28. Finally, to obtain an 11 degree launching angle, neither of the switches 46 is operated and both actuators 28 and 30 are retracted, as shown in FIG. 9D. Although this embodiment of the invention has been shown and described using two such switches 46 and actuators 28 and 30, it will be appreciated that a smaller or greater number of switches 46 may be used to adjust the launcher's launching angle.

Suitable actuators 28, 30, 56 and 72 of the type described above are available from Clippard Instrument Laboratory, Inc., of Cincinnati, Ohio and are sold under Model No. SDR-17. Suitable switches 46 and 47 of the type described above also are available from Clippard Instrument Laboratory, Inc., of Cincinnati, Ohio and are sold under the designations MAC 45 for the switch 47 and MJV-4 with 11925 cam roller for the switches 46.

Figure 10A:
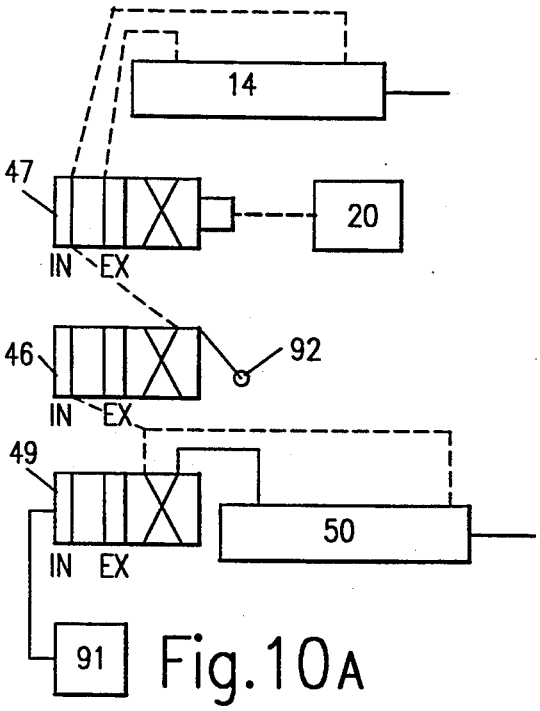
FIGS. 10A–10D are block diagrams showing a pneumatic circuit for controlling operation of the indexing and stop mechanisms.
Figure 10B:
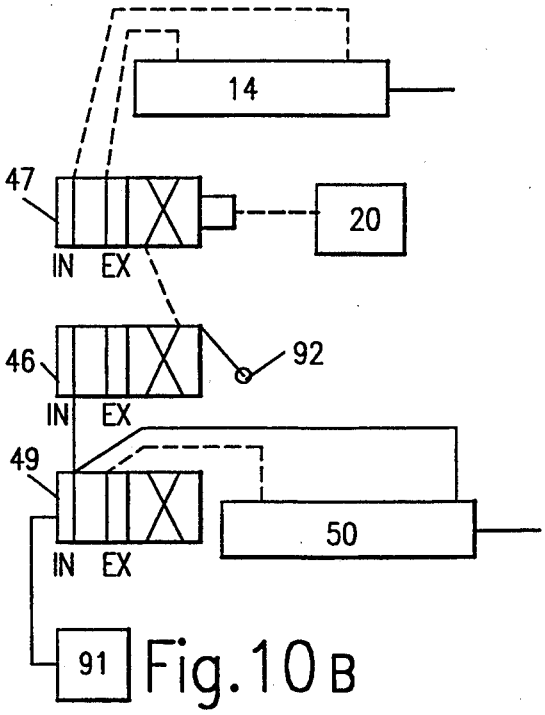

The overall operation of the launcher 10 will now be described in conjunction with FIGS. 10A–10D. In FIGS. 10A–10D, the solid lines between the switches 46, 47 and 49 and the stop mechanism 14 and the indexing mechanism 50 represent pressurized lines, while the dashed lines represent exhaust or vented lines. Before a first launching cycle takes place, the pressure tank 20 is depressurized and the launching tubes 16 can be in any random orientation relative to the output port 44 of the valve 42. In preparing the launcher 10 for the first launch, the local control unit 91 sends a signal that operates a switch 49 so as to initiate an indexing cycle that rotates the frame 34 until a predetermined "home" launching tube 16 is registered with the output port 44 of the valve. This indexing cycle is illustrated in FIGS. 10A–10B. In the preferred embodiment, the switch 49 is an electric solenoid switch with a spring return, such as the switch sold under the designation MAC 45 by Clippard Instrument Laboratory, Inc., of Cincinnati, Ohio. This switch 49 is energized by about 24 volts. The indexing to the home launching tube 16 may take several separate indexing cycles which are carried out automatically until a sensor (not shown) signals the local control unit 91 to indicate that the "home" launching tube 16 has been properly registered. During indexing to the "home" launching tube 16, the plunger 78 is, of course, disengaged from the notch 80.

Once the "home" launching tube 16 has been properly registered, the rod 62 of the indexing mechanism 50 stays in the extended state and the plunger 78 of the stop mechanism 14 remains in the disengaged position, even though no further indexing is commanded. At this point, the appropriate projectiles 12 are loaded into their respective launching tubes 16 as desired and their leads 88 are connected to their respective terminals 84. As previously described the fuses 114 on the projectiles 12 cannot be programmed or otherwise cause the projectile to detonate in the launching tubes 16 because the terminals 84 are shunted. The cams 48 associated with each launching tube 16 also are checked and adjusted if necessary to properly aim the launcher 10 when the launching tubes 16 are successively indexed into registration with the output port 44 of the valve 42 for launching.

In practice, the "home" launching tube 16 may be visibly identified, and the steps described above regarding loading of the projectiles 12 into the launching tubes 16 and adjustment of the cams 48 may be carried prior to indexing of the launcher 10 to register the "home" launching tube.

Figure 10C:
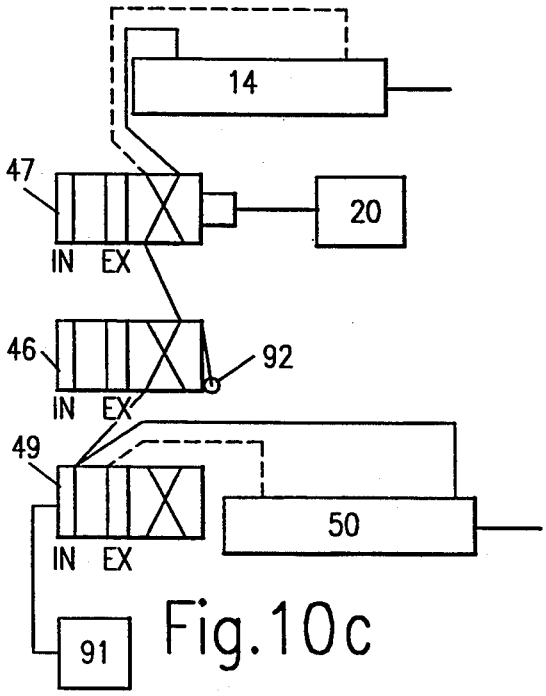

With the launcher 10 appropriately loaded, the launcher is ready to begin the first launching cycle, as shown in FIG. 10C. This commences with pressurization of the pressure tank 20 to the appropriate level, as controlled and monitored by the local control unit 91. Pressurization of the pressure tank 20 also routes pressure to operate to the pressure operated switch 47. By operating this switch 47, pressure is routed to the actuator 56 of the indexing mechanism 50 to cause the rod 62 to move from the extended position to the retracted state so that the indexing mechanism 50 is ready for the next indexing cycle after launch. The same switch 47 also will route pressurized air to cause the plunger 78 of the stop mechanism 14 to move from the disengagement position to the engagement position to prevent further indexing. When the plunger 78 engages the notch 80, the contacts 82 also engage the terminals 84 and program the fuse 114 of the projectile 12 to be launched through appropriate programing signals sent from the local control unit 91.

Figure 10D:
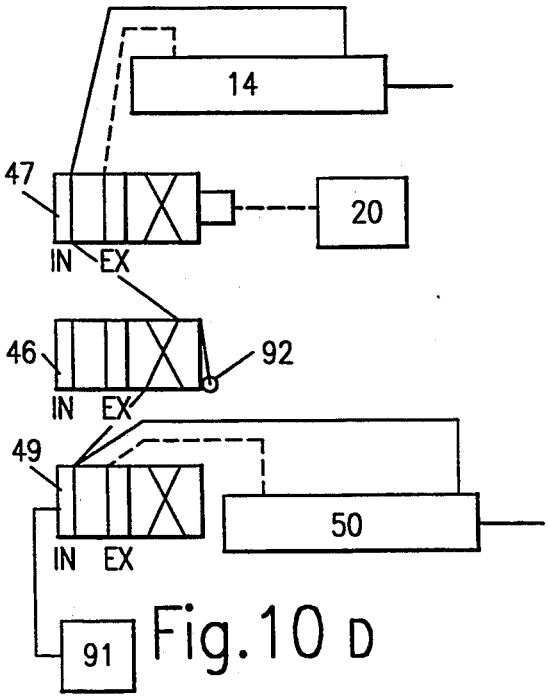

After the fuse 114 has been programmed and all systems are checked, the projectile 12 is ready to be launched. Hence, the local control unit 91 will send a signal that opens the valve 42 and releases the compressed gas from the pressure tank 20 to launch the projectile 12, as shown in FIG. 10D. As soon as the pressure tank 20 has been vented, it will be sensed by the switch 47 and pressure will be routed to the stop mechanism 14 to move the plunger 78 to the disengagement position. When it is desired to carry out the next indexing cycle, a signal will be sent to the switch 49 to energize it and cause the indexing mechanism 50 to index the next launching tube 16, according to the cycle shown in FIGS. 10A–10B. During the indexing cycle, the cams 48 will operate the switches 46 to route pressurized air to the actuators 28 and 30 to appropriately adjust the position of the actuators and aim the launcher 10. The pressure tank 20 is then pressurized at the appropriate time upon receiving a command from the local control unit, and the launch sequence described above is repeated for the next projectile.

Figure 11:
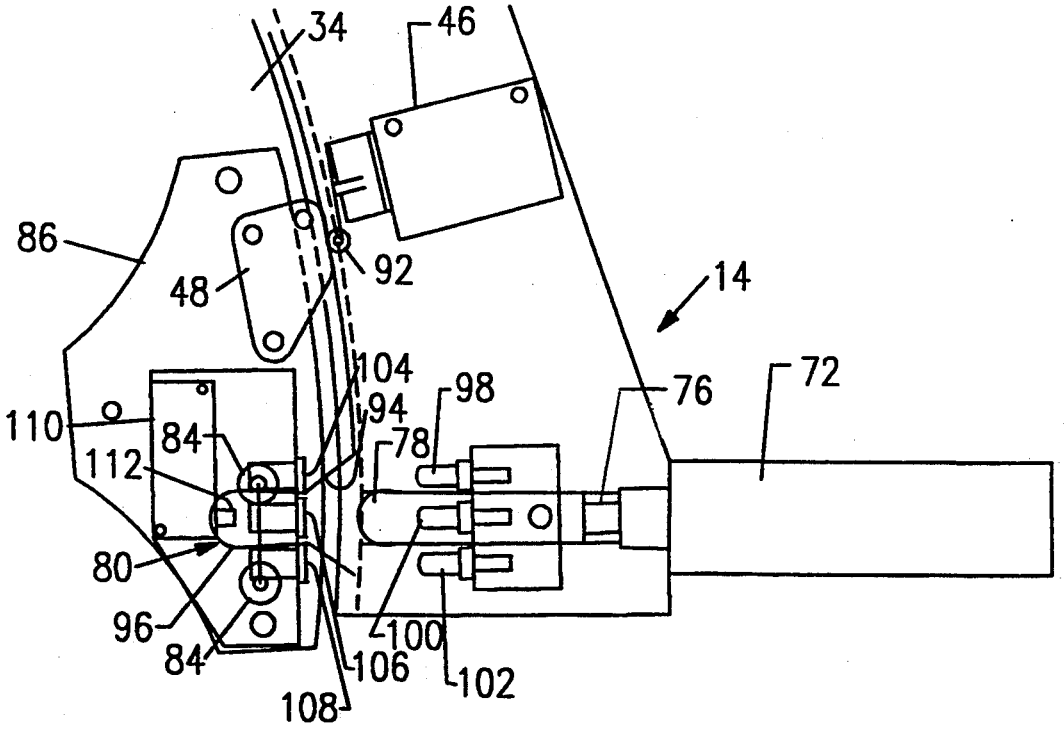
FIG. 11 is a plan view of a portion of the launcher showing another embodiment of the stop mechanism.
Figure 12:
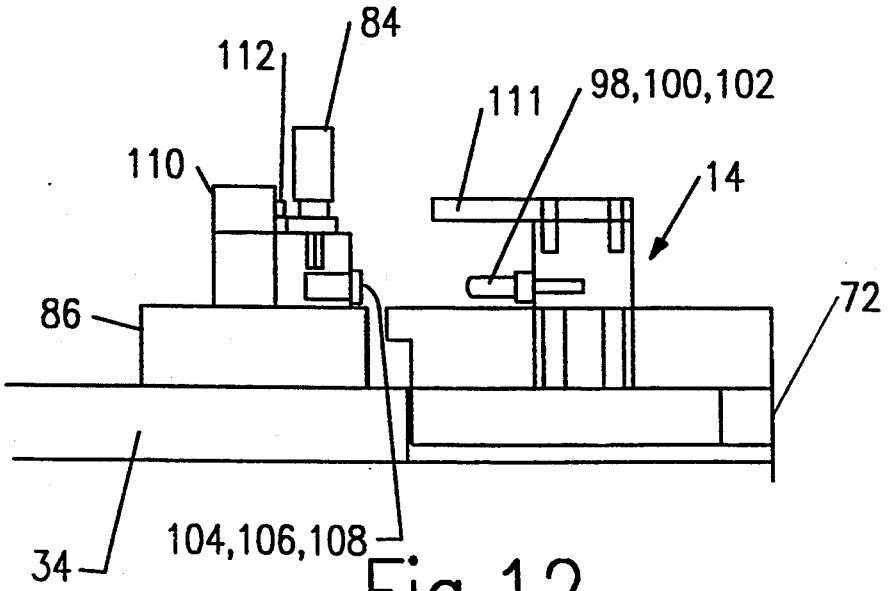
FIG. 12 is an elevational view of the stop mechanism of FIG. 11.

FIGS. 11–12 show another embodiment of a stop mechanism 14 for the launcher 10. Like the stop mechanism 14 shown in FIGS. 6–7, the stop mechanism 14 shown in FIGS. 11–12 performs the same functions of preventing indexing of the launching tubes 16 when the pressure tank 20 is pressurized and enabling programming of the fuse 114 on the projectile 12 to be launched, while preventing inadvertent or accidental detonation of the projectile until the fuse 114 is programmed and ready to be launched.

The stop mechanism 14 of FIGS. 11–12 comprises an actuator 72 having a cylinder 74 and a rod 76 with a plunger 78 connected to the outer end of the rod. The plunger 78 is adapted to move between a disengagement position, shown in FIG. 11, in which the plunger is retracted away from the frame 34 holding the launching tubes 16. While in the disengagement position, the indexing mechanism 50 is free to rotate the frame 34 and cause appropriate indexing of the next launching tube 16 into registration with the output port 44 of the valve 42. In the engagement position, the plunger 78 is extended toward the frame 34 and into engagement with a notch 80 in the frame. While in the engagement position, the frame 34 is prevented from rotating and, thus, there can be no accidental or inadvertent indexing of the launching tubes 16. In these respects, the stop mechanism 14 of FIGS. 11–12 is the same as the stop mechanism 14 of FIGS. 6–7 and, hence, the same reference numerals have been used to identify the common parts.

The stop mechanism 14 of FIGS. 11–12 differs from the stop mechanism 14 of FIGS. 6–7 in three main areas. The first area is the configuration of the notch 80. In this second embodiment, the notch 80 has a tapered entrance 94 leading to an inner portion 96 whose width is just slightly greater than the width of the plunger 78 it receives. The close tolerances between the dimensions of the notch's inner portion 96 and the plunger 78 substantially prevents any rotation of the frame 34 with respect to the plunger when in the engagement position. The tapered entrance 94 leading to the inner portion 96 of the notch 80 helps guide the plunger 78 into the inner portion should the frame 34 be slightly out of position at the time the plunger is advanced into the notch.

Programming of the fuse 114 on the projectile 12 and preventing inadvertent or accidental detonation is carried out by three plugs 98, 100 and 102 mounted on the plunger that engage three corresponding sockets 104, 106 and 108 mounted on the mounting plate 86 associated with each launching tube 16. These plugs 98, 100 and 102, known as banana plugs, and the sockets 104, 106 and 108 replace the contact 82 of the first embodiment that engages the terminals 84 to carry out the fuse programming and other functions. Two of the plugs 98 and 102 engage their respective sockets 104 and 108 to carry out the function of programming the fuse 114 on the projectile 12, while the third plug 100 engages the socket 106 and grounds the launching tube 16 to prevent static charges from accumulating in the tube that could cause inadvertent or accidental detonation. As before, the terminals 84 are designed to receive the leads 88 associated with each projectile 12, and each of these terminals is then connected to a respective one of the two sockets 104 and 108 for programming purposes. The close tolerances between the plunger 78 and the inner portion 96 of the notch 80 enable precise alignment of the plugs 98, 100 and 102 with their respective sockets 104, 106 and 108 so that a proper connection between the plugs and sockets is ensured.

Accidental or inadvertent detonation of the projectile 12, as before, is prevented by shunting the leads 88. In this embodiment, the leads 88 are normally shunted with a microswitch 110. In this normally shunted condition, the fuse 114 is dead and cannot be programmed to detonate the projectile 12, i.e., the microswitch 110 is normally closed. However, when the plunger 78 is advanced into the notch 80 in the engagement position, the outer end of a bar 111, connected for movement with the plunger 78, depresses a button 112 on the microswitch 110. This opens the microswitch 110 and unshunts the leads 88. In this unshunted condition, the fuse 114 is live and can be programmed by the local control unit 91 to detonate the projectile 12 at a predetermined time after launch. It will be appreciated that other forms of switches may be used instead of the microswitch 110, such as a reed switch.

While a particular form of the invention has been illustrated and described, it will be apparent that various modifications can be made without departing from the spirit and scope of the invention. Therefore, it is not intended that the invention be limited, except as by the appended claims.

We claim:

1. A method of successively launching a plurality of projectiles for exploding into an aerial pyrotechnic display from a launcher having a pressure tank for containing a compressed gas, a plurality of launching tubes for holding the projectiles, and a valve connected to the pressure tank and having an output port registrable with a selected one of the launching tubes, the method comprising the steps of:

(a) loading a plurality of projectiles into the launching tubes;

(b) pressurizing the pressure tank with a compressed gas and preventing indexing of another of the launching tubes into registration with the output port of the valve when the pressure tank is pressurized;

(c) opening and then closing the valve to accurately introduce a predetermined amount of compressed gas from the pressure tank into the selected one of the launching tubes to launch a projectile into the air; and (d) depressurizing the pressure tank and permitting indexing of another of the launching tubes into registration with the output port of the valve.

2. The method of claim 1, further comprising the step of changing the launching angle of the launcher when another of the launching tubes is indexed into registration with the output port of the valve.

3. A method of launching a plurality of fireworks projectiles from a launcher, comprising the steps of:

(a) loading a plurality of fireworks projectiles into launching tubes arranged to form a magazine;

(b) registering one of the launching tubes with the output port of a valve adapted to release compressed gas from a pressure tank;

(c) moving a plunger into engagement with the magazine to prevent indexing of another of the launching tubes into registration with the output port of the valve;

(d) pressurizing the pressure tank with a compressed gas;

(e) opening and then closing the valve to allow compressed gas from the pressure tank to eject the fireworks projectile from the launching tube;

(f) substantially depressurizing the pressure tank;

(g) withdrawing the plunger from the magazine; and
(h) indexing another of the launching tubes into registration with the output port of the valve.

4. The method of claim 3, further comprising the step of adjusting an actuator on the launcher to change the launching angle of the launcher when another of the launching tubes is indexed into registration with the output port of the valve.

5. The method of claim 4, wherein the step of adjusting the actuator on the launcher to change the launching angle of the launcher further includes the step of actuating a switch on the magazine during the step of indexing another of the launching tubes into registration with the output port of the valve, wherein the switch is adapted to adjust the actuator.

6. The method of claim 5, wherein the actuator is operated by a pneumatic circuit for controlling operation and adjustment of the actuator.

7. The method of claim 3, wherein the plunger is pneumatically operated and moved into engagement with the magazine by means of a pneumatic circuit.

8. The method of claim 3, wherein the indexing of another of the launching tubes into registration with the output port of the valve is carried out by a pneumatically operated indexing mechanism.

9. The method of claim 8, wherein the plunger is pneumatically operated and moved into engagement with the magazine by means of a pneumatic circuit.

10. The method of claim 9, wherein the pneumatically operated indexing mechanism and the pneumatically operated plunger are connected for operation to a common pneumatic circuit.

11. The method of claim 10, wherein the common pneumatic circuit is controlled by a switch on the magazine that is actuated during the step of indexing another of the launching tubes into registration with the output port of the valve.

12. A method of launching a plurality of fireworks projectiles from a launcher, comprising:
(a) loading a plurality of fireworks projectiles into launching tubes arranged to form a magazine;
(b) registering one of the launching tubes with the output port of a valve adapted to release compressed gas from a pressure tank;
(c) adjusting an actuator on the launcher to position the launcher at a predetermined launching angle;
(d) pressurizing the pressure tank with a compressed gas; and
(e) opening and then closing the valve to allow compressed gas from the pressure tank to eject the fireworks projectile from the launching tube;
(f) wherein adjustment of the actuator on the launcher to position the launcher at a predetermined launching angle includes actuating a switch on the magazine during the step of registering one of the launching tubes with the output port of the valve, wherein the switch is adapted to adjust the actuator.

13. The method of claim 12, wherein the actuator is operated by a pneumatic circuit for controlling operation and adjustment of the actuator.

14. A method of launching a plurality of fireworks projectiles from a launcher, comprising the steps of:
(a) loading a plurality of fireworks projectiles into launching tubes arranged to form a magazine;
(b) registering one of the launching tubes with the output port of a valve adapted to release compressed gas from a pressure tank;
(c) moving a plunger into engagement with the magazine to prevent indexing of another of the launching tubes into registration with the output port of the valve;
(d) programming an electronic fuse on the fireworks projectile in the launching tube registered with the output port of the valve, so that the fireworks projectile will be detonated by the fuse at a predetermined time after it has been launched;
(e) pressurizing the pressure tank with a compressed gas; and
(f) opening and then closing the valve to allow compressed gas from the pressure tank to eject the fireworks projectile from the launching tube.

15. The method of claim 14, wherein the step of programming the electronic fuse includes the steps of:
(a) connecting leads on the projectile with terminals on the magazine;
(b) engaging contacts on the plunger with the terminals on the magazine when the plunger engages the magazine to prevent indexing of the launching tubes; and
(c) transferring programming information from a control unit to the fuse through the engagement between the contacts on the plunger and the terminals on the magazine.

16. The method of claim 15, wherein the leads are shunted prior to engagement between the contacts on the plunger and the terminals on the magazine.

17. The method of claim 14, further comprising the steps of:
(a) substantially depressurizing the pressure tank after the fireworks projectile has been launched;
(b) withdrawing the plunger from the magazine; and
(c) indexing another of the launching tubes into registration with the output port of the valve.

18. A method of launching a plurality of fireworks projectiles from a launcher, comprising the steps of:
(a) loading a plurality of fireworks projectiles into launching tubes arranged to form a magazine;
(b) registering one of the launching tubes with the output port of a valve adapted to release compressed gas from a pressure tank;
(c) adjusting an actuator on the launcher to position the launcher at a predetermined launching angle;
(d) moving a plunger into engagement with the magazine to prevent indexing of another of the launching tubes into registration with the output port of the valve;
(e) programming an electronic fuse on the fireworks projectile in the launching tube registered with the output port of the valve, so that the fireworks projectile will be detonated by the fuse at a predetermined time after the projectile has been launched;
(f) pressurizing the pressure tank with a compressed gas;
(g) opening and then closing the valve to allow compressed gas from the pressure tank to eject the fireworks projectile from the launching tube;
(h) substantially depressurizing the pressure tank;
(i) withdrawing the plunger from the magazine; and
(j) indexing another of the launching tubes into registration with the output port of the valve.

* * * * *